United States Patent [19]

Wilcox et al.

[11] Patent Number: 5,019,973

[45] Date of Patent: May 28, 1991

[54] POKER GAME METHOD

[75] Inventors: Joseph Wilcox, Las Vegas, Nev.; Alfred H. Wilms, Schilde, Belgium

[73] Assignee: Gaming and Technology, Inc., Las Vegas, Nev.

[21] Appl. No.: 320,493

[22] Filed: Mar. 8, 1989

[51] Int. Cl.[5] ..... A63F 1/00

[52] U.S. Cl. ..... 364/412; 273/85 CP; 273/85 G

[58] Field of Search ..... 273/143 R, 269, 138 A, 273/D28, 85 CP, 85 G; 364/412

[56] References Cited

U.S. PATENT DOCUMENTS

| | | | |
|---|---|---|---|
| 4,560,171 | 12/1985 | Anthony | 273/269 |
| 4,570,934 | 2/1986 | Smyth | 273/143 R |
| 4,624,459 | 11/1986 | Kaufman | 273/138 A |
| 4,676,506 | 7/1987 | Crouch | 273/143 R |
| 4,760,527 | 7/1988 | Sidley | 273/D28 |

*Primary Examiner*—Allen R. MacDonald
*Assistant Examiner*—Roger S. Joyner
*Attorney, Agent, or Firm*—Brown, Martin, Haller & McClain

[57] ABSTRACT

A computer card game using a video screen which allows the player to make a second wager for an additional card after a first card has been dealt which will be compared with the cards in the first card hand. The matching cards are defined as Jokers or Wild Cards which will then be used to define the best card hand. The amount of the second wager can be fixed and the payout will vary according to the first card hand. Alternatively, the amount of the second wager can vary and the payout will remain the same. The player has the option to terminate the game if he chooses not to register the second wager. The game is won or lost when the card hand as configured is compared to the ranking of card hands on the payout table, which also determines the amount of the payout, if any. In one embodiment, the player is permitted to substitute at least one card in the first card hand before the second wager is registered.

15 Claims, 6 Drawing Sheets

PLAYER'S FIRST HAND.

ADDITIONAL CARD IS DEALT AND QUALIFIES AS A JOKER.

CARDS QUALIFYING AS JOKER ARE BEING REDEFINED IN CONJUNCTION WITH NON-JOKER CARDS TO FORM THE BEST CARD HAND

PLAYER IS GIVEN THE OPTION TO CONTINUE PLAY

PLAYER HOLDS TWO CARDS

PLAYER IS DEALT THREE NEW CARDS

POKER GAME METHOD

FIELD OF INVENTION

This invention relates to a method of playing cards, and more particularly, to a poker-type game that can be played as a computer video game.

BACKGROUND OF THE INVENTION

The objective of most card games is for one player to obtain a winning hand against other players or the dealer of the cards. The winning hand is usually defined by ranking, that is, by comparing the configuration of the cards in the hands of each player to the hands of other players in accordance with established rules for the game. For example, in a poker game, hands are ranked in ascending order as follows: high cards, one pair, two pairs, three of a kind, straight, flush, full house, four of a kind, and straight flush.

The ranking of the card hand as configured in turn depends on the values or suits of the cards held by the player. In such games, there is a certain probability, or chance, of obtaining a card configuration which results in a winning hand. In a game for wager, the winning hand entitles the player to a reward. As in all games involving wagering, the player pays for the probability associated with obtaining the potential reward. Probability and the potential reward are the key factors in defining the value of the card hand. Because of the potential rewards and the chance-orientation arising out of the laws of probability, card players, particularly those who are risk-oriented, find such games exciting.

The excitement of a card game will be enhanced if the player is offered an opportunity to change the odds of winning. There are card games which allow a player to replace some or all of the existing cards in his hand with new cards to be drawn from the remaining deck of cards. This changes the odds of winning associated with the card configuration, since as new cards are drawn from the remaining deck of cards the probability of obtaining a particular desirable card can increase. However, without a commensurate increase in the expected return to the dealer or the casino, a card game offering the player repetitive opportunities to replace his cards is not always desirable. Since the probability of drawing a particular card increases when additional cards are drawn, the risk exposure for the dealer will also be increased. At the same time, repetitive replacement of cards is time consuming.

Thus, it has always been desirable to condition repetitive drawing of cards on additional wagers being placed. The player is attracted to such challenges of wagering in the hope of winning a disproportionate larger amount in reward. Ideally, as each drawing of a card is offered, the wagering (monetary) amount should be increased so as to offset the risk exposure to the dealer and for him to derive additional wagering income. There are variations of poker games in which the opportunity for the player to replace the cards is offered for an additional wager. For example, in U.S. Pat. No. 4,743,022, a casino-type draw poker game is described. In this game, the player is dealt five cards and, at his option, up to five cards can be replaced from the remaining deck to form a second hand. This completes the first round of card playing, whereupon the card hand will be ranked according to a posted odds chart to determine whether the player has won or lost. In addition, the player is asked to wager for an opportunity to draw a sixth card so as to make the best poker hand from the sixth card, provided that the sixth card creates the possibility of the resulting hand having a rank of straight or higher.

The drawback of this poker method is that the offer to place a second round of wagering will be made only when there is a possibility that the card hand at the end of the first round can achieve a rank of straight or higher. This method limits the number of second rounds that additional wagering can be offered since the number of combinations for such a possibility is limited.

In addition, from the reading of the first card hand, any possible winning combinations will be obvious to the player before he places the second wager. This certainty detracts from excitement, since excitement can only be derived from the player's risking his second wager in the hope of obtaining a particular card from the remaining deck of cards.

Accordingly, there is a need to encourage repetitive wagering which will not be limited by the ranking of the preceding card hand. Further, it would be advantageous to enhance the excitement in a card game by offering card hand combinations which are not easily predictable.

SUMMARY OF THE INVENTION

This invention provides a method of playing a card game using a computer having an input device and video screen. The method comprises the steps of: registering a first wager with the computer, generating and displaying a representation of a card hand consisting of a plurality of cards from a deck of playing cards, registering a second wager with the computer, generating and displaying a representation of an additional card from the remaining card deck, comparing the value and/or suit of the additional card with the values and/or suits of the cards in the card hand, and if the additional card matches the value or suit of a first card in the card hand, changing the value or suit of the first card to the value or suit of a second card in the card hand to form a rank for the card hand, comparing the ranking of the new card hand to a predetermined payout table, and determining the payment to the player. Even if the first additional card matches the value of a card in the card hand, the game may offer the player the chance to wager again and receive an alternate additional card from the deck and to use an alternate deck or additional decks, and to repeat this procedure until the player elects to terminate the game. The computer can be used to determine the amount of the wager required, as well as the win or lose status and the payout of the card hand according to the odds in a payout table. The computer may also change the payouts or adjust them under specified situations. Determination of the ranking of the card hand and the amount of the payout can be made either before or after any additional cards are offered for wager.

In one embodiment of the invention, the game is played using a computer and video screen and involves the steps of registering a first wager with the computer, generating and displaying a representation of a first card hand consisting of a plurality of cards from a deck of playing cards, discarding any number of cards in the first card hand, generating and displaying a replacement card for each card discarded to form a second card hand from the balance of cards in the card deck; offering to terminate the game or to play a third card hand for a second wager, determining whether the player has won or lost the first wager based on a ranking in a payout table; generating and displaying a representation of an additional card from the remaining card deck, matching its value and/or suit with the values and suits of the cards in the second hand, and if the additional card matches the value or suit of a first card in the second hand, changing the value and/or suit of the first card to the value or suit of a second card in the card deck to form a rank for the second hand; and offering additional card drawings.

In preferred embodiments, the generation of cards is random.

PREFERRED EMBODIMENTS OF THE INVENTION

The method of this game is played by means of a computer. Player interaction is provided by input and output means, such as a keyboard, light pen system or a touch-responsive panel, and a video screen. Coin receiving and disbursement means accept the wager placed by the player and provide for the disbursement of winning payouts. The input and output devices as well as the coin manipulating mechanism are readily available and are well known in the gaming industry.

Figure 1:
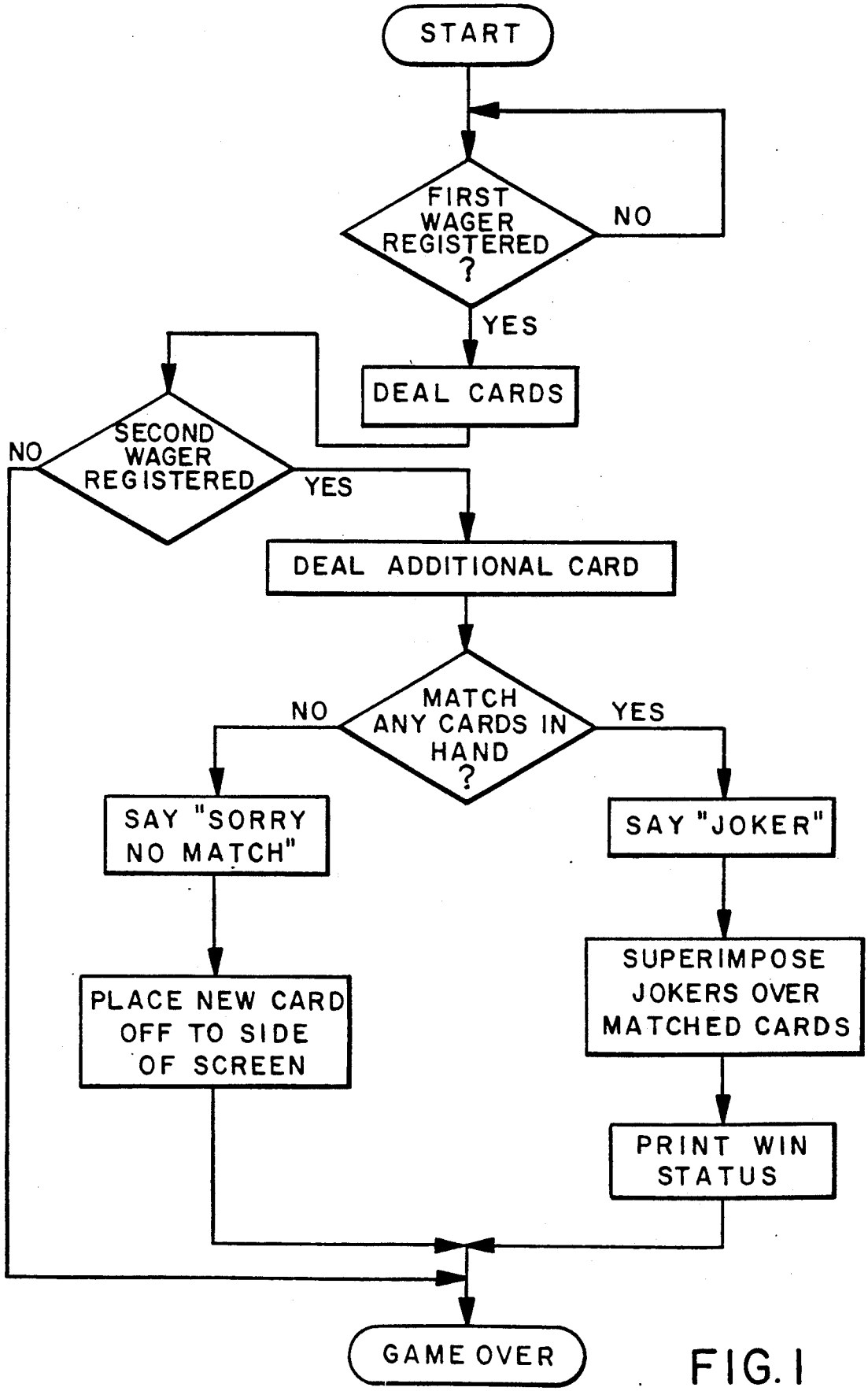
FIG. 1 is a flow chart for the development of a computer program for playing one embodiment of the game.

FIG. 1 is a flow chart for the development of a computer program for playing the game. Table is pseudo computer code for the implementation of the game. The game is started by registering a wager with the computer. In a typical casino setting where the game is played using a coin receptacle and disbursement unit, the player initiates the game by depositing the required wager into the receptacle. The amount of each wager is preferably set at a coin value or multiples of that value. The payout table, which shows the ranking of card hands and their associated payouts or rewards against the amount of wager, is preferably predetermined and shown to the player prior to each wager. Responding to the registration of the wager, the computer generates (preferably randomly) a predetermined number of cards from a deck of cards. In a preferred embodiment of the invention, a five-card first hand is generated out of the standard fifty-two card deck. In other embodiments of the invention, other numbers of cards can also be dealt. For instance, if one wants to play a game comparable to the well-known "spit in the ocean" poker game, a sixth (wild) card is automatically dealt. Likewise, a "deck" may be composed of a plurality of fifty-two card regular decks which may also be "expanded" to include one or more joker card(s).

Figure 2:
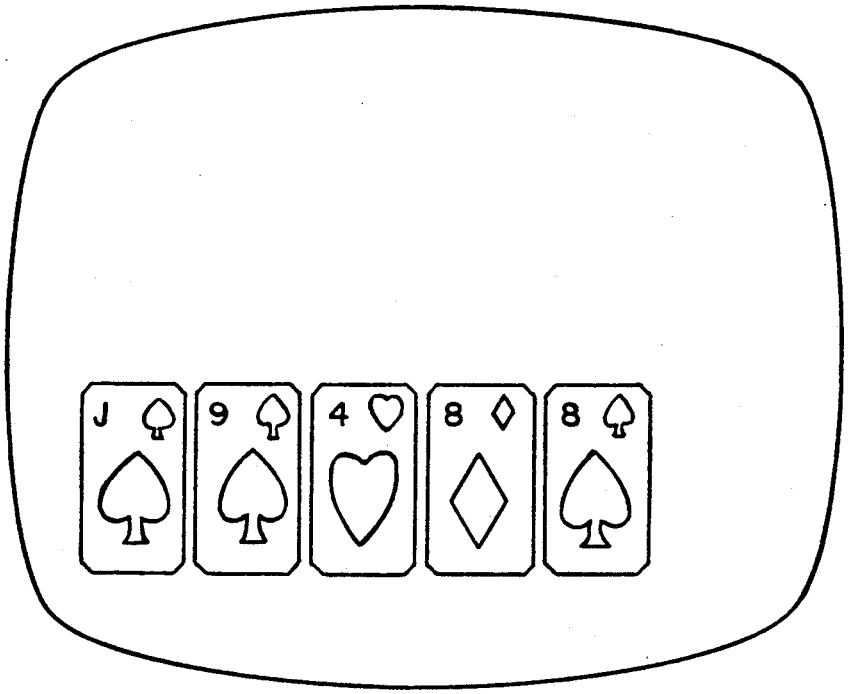
FIG. 2 shows a first card hand when the game has been started.

The first card hand is displayed on the video screen as shown in FIG. 2. The player may now elect to either register a second wager or to terminate the game. If termination of the game is elected, the first card hand will be compared to the payout table to determine whether the player is entitled to a reward. If he elects to register the second wager, the computer will generate an additional card which will be compared both in value and/or suit with each card in the player's first hand. Any cards in the hand which match the additional card will then qualify as Jokers or Wild Cards, and can assume any rank as in a standard card deck. As used herein, the value of a card is its numerical value which also includes the Jack, Queen, King and Ace. The rank of a card means both the value and suits of the card. The ranking of a card or card hand is established when the value(s) and/or suit(s) are compared to the value(s) and/or suit(s) of other card(s) or card hand(s) under the rules of the game.

Figure 3:
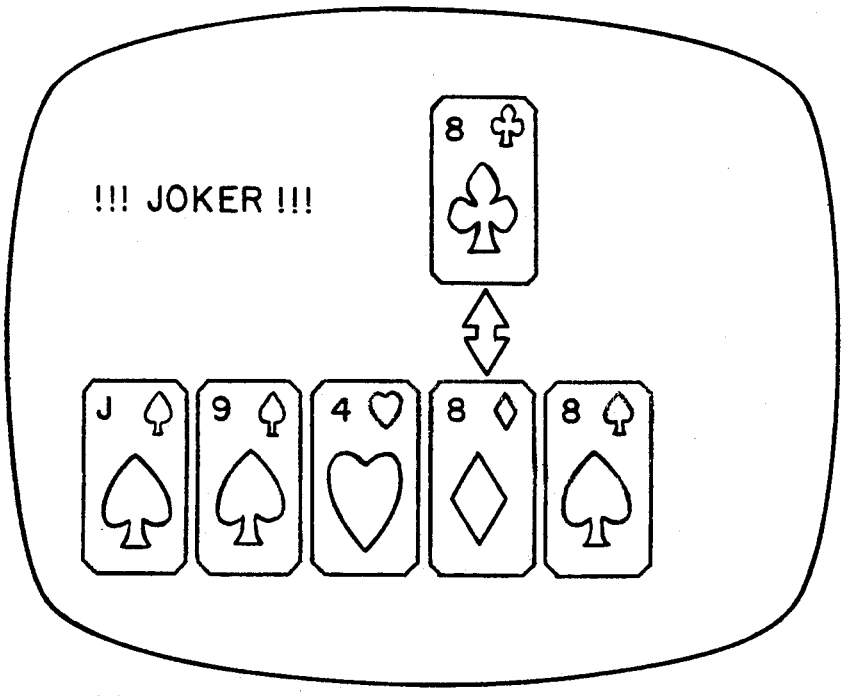
FIG. 3 shows an additional card that has been drawn in the game, which matches the suit or value of one or more cards in the first card hand resulting in the matching cards being defined as "JOKER" cards.
Figure 4:
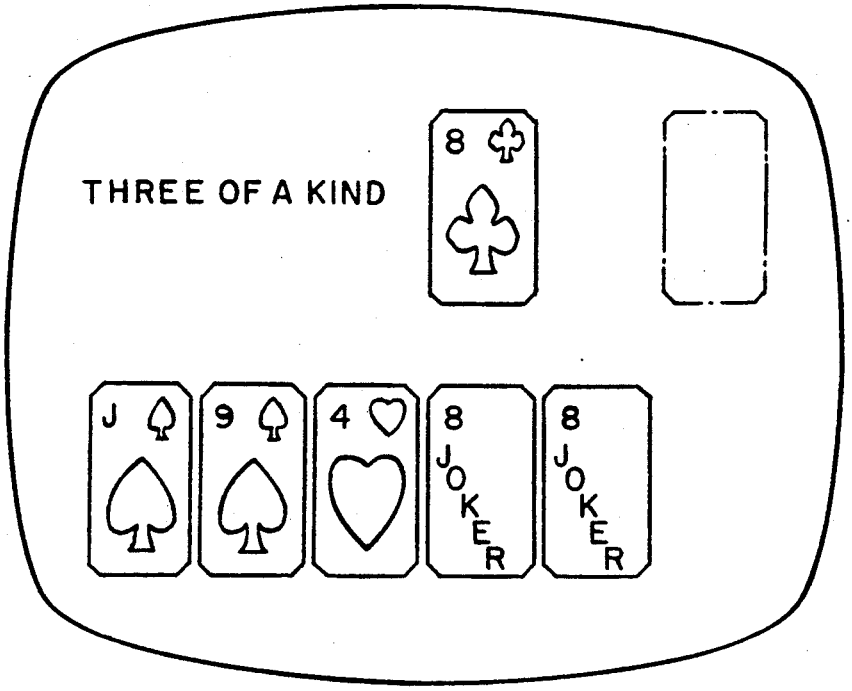
FIG. 4 shows the best card hand in using the "JOKER" cards.

The additional card appears on the screen above the corresponding or matching hand cards, as shown in FIG. 3. As an example, an eight is drawn which corresponds to a pair of eights already in the hand of a player. The additional card, together with the two eights, will be defined as Jokers or Wild Cards, and the computer will generate the word JOKER as a display to so indicate. Concurrently, the computer generates and displays an indication, preferably by a two-way arrow, that such a corresponding relationship exists. Thereafter, the cards in the player's hand that qualify as Jokers are superimposed by a JOKER card, as shown in FIG. 4.

In a preferred embodiment of the invention, the value and/or suit of any of the Jokers or Wild Cards in the hand will be redefined to be equal to at least one of the remaining cards in the player's hand which are not Jokers. The value of the JOKER cards will be selectively changed to any value and/or suit which allows them to be used in conjunction with the non-JOKER cards in the card hand to form the best hand configuration permissible under the game. In this respect, the new rank of the JOKER cards are dependent on the non-JOKER-cards. In the specific example illustrated in FIGS. 3 and 4, the two Jokers or Wild Cards in the card hand can assume any value or suit, ranging from two to Ace or any suit in a standard card deck. In view of the three remaining cards, Jack, nine and four, the best choice of card ranking which can be configured in the game is three Jacks. Thus, a three-of-a-kind combination of Jacks will be configured and noted as shown in FIG. 4. In this example, the value (numerical) of each of Jokers has been changed from an eight to a Jack. Comparing this combination to the payout table, the win or lose status will be established together with the payout which is to be made via the coin disbursement or hopper unit. In a typical casino video card game, the player loses his wager when his card hand ranks lower than the card hand rankings having corresponding payouts in the payout table.

Similarly, the Jokers may be separately changed to different values and/or suits, e.g. so that the player may fill a straight or flush or create a full house. In the case of a flush, the suit may be changed but the value may or may not be changed. (The program should not change values or suits where this would have the effect of duplicating a card already in play.)

Thus, this invention provides a method where the ranks of the individual cards are redefined by card matching. Card matching therefore creates the probability of reconfiguring a card hand which is not possible in the prior art. Through this method, the risk-oriented player may therefore enjoy greater odds in achieving a winning hand, since offering of the additional card now creates new possibilities for card combinations.

If the additional card does not match any of the cards in the existing hand, it will be discarded to a designated area on the video screen, as shown by the phantom-lined area in FIG. 4. At this point, the game is terminated.

Figure 5:
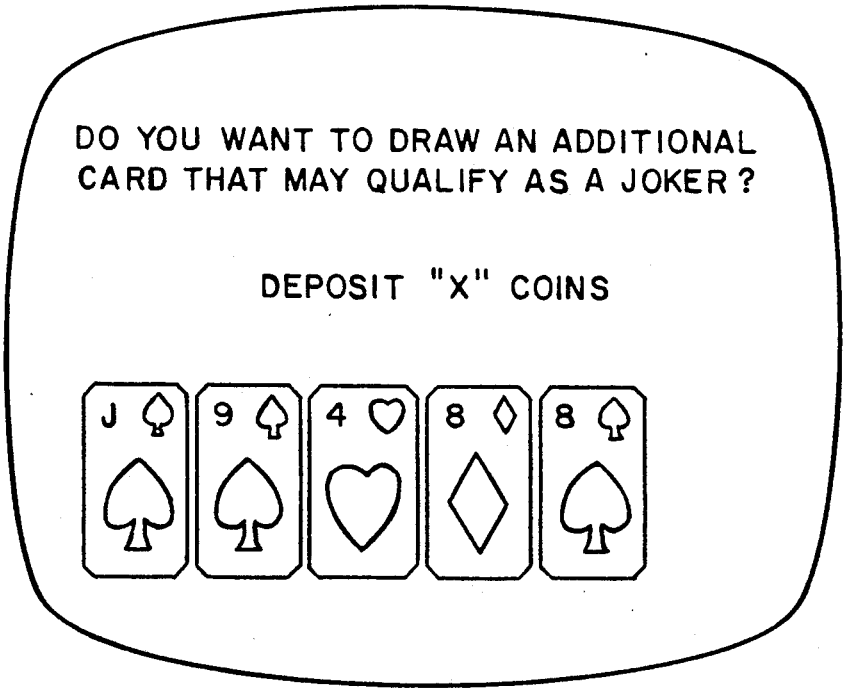
FIG. 5 shows the offering to the player to wager for an additional card.

In another embodiment of the invention, after the additional card has been discarded or converted to a Joker, the player can have the computer propose to the player to wager for another additional card, as shown in FIG. 5. This sequence may be repeated, so that the player will be offered several opportunities to wager for Jokers or Wild Cards through the purchase of an additional card each time a hand has been played, regardless of whether he has previously obtained any matching cards or winning hands. As an alternate embodiment, if the additional card does not match any of the cards in the existing card hand as described above, it will not be discarded. Rather, the non-matching additional card will be added to the card hand. Then a second additional card will be drawn, which will be compared in value and/or suit with all the cards in the new card hand so the best new card hand can be configured. Thereafter, the new card hand will be compared with the ranking of cards in the payout tables for determining whether it is a winning or losing hand. The game thus affords the player the opportunity to change the card hand, and take advantage of the changing probabilities of drawing better cards, thereby generating interest and excitement. At the same time, as compensation for risking the potential winning amounts, the dealer or casino will be able to derive additional wagering income.

The amount of the wager for each additional card can be calculated in several ways. For example, in one preferred embodiment of the invention, it is calculated as a function of the potential win and the corresponding probability to obtain such a win. The amount asked may be different for every combination of cards in the player's card hand appearing on the screen. In this case, the payout amounts may be constant and the payout table can be fixed and shown to the player. In another approach, the amount of the second wager can be the same as the amount of the wager at the start of the game. Here, the payout table for any particular winning combination can be adjusted as a function of the potential win that the player may realize for having a Joker or Wild Card. As before, the payout table should be shown to the player prior to the registration of the wager.

Figure 6A:
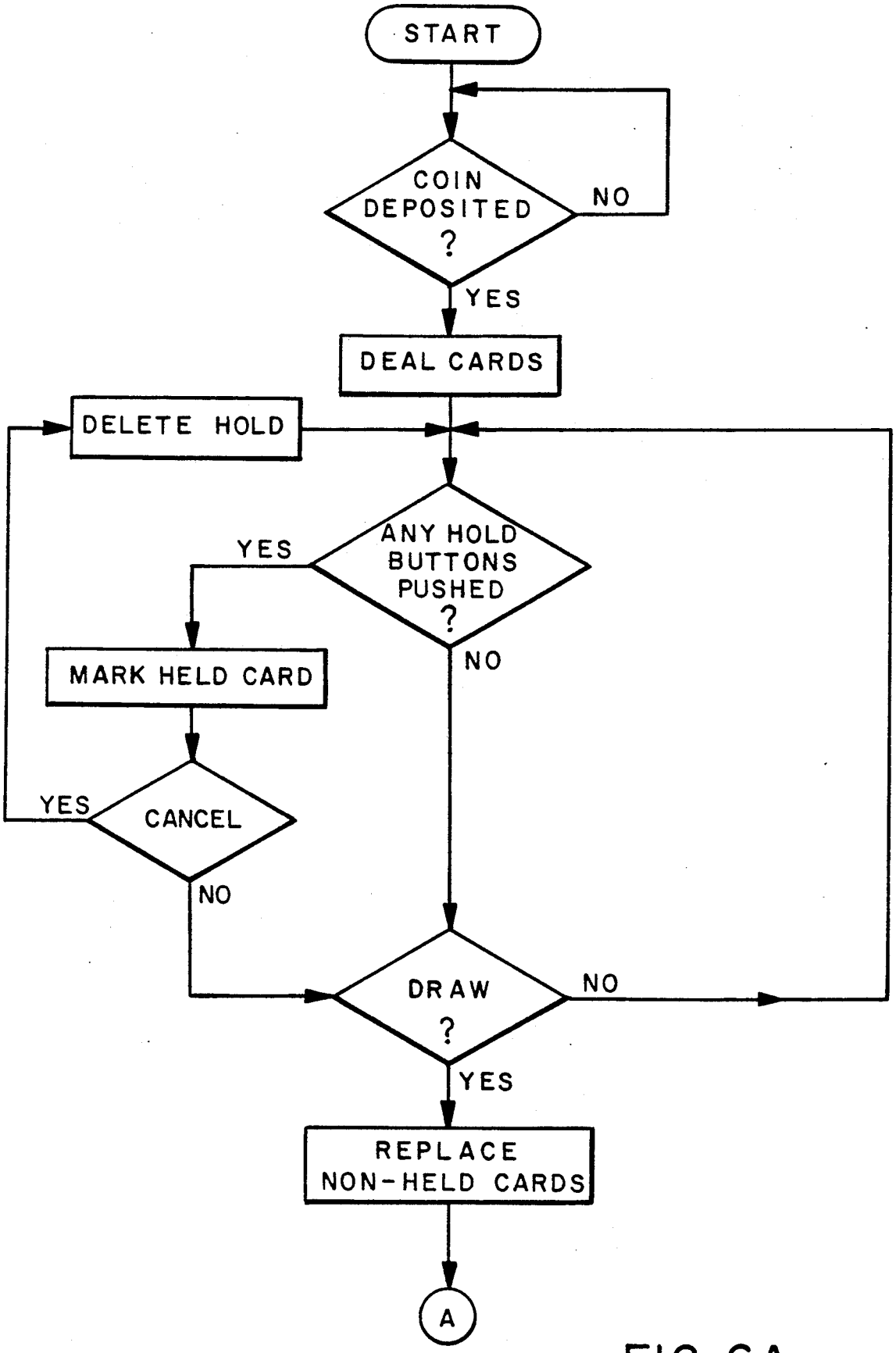
FIGS. 6A and 6B shows a flow chart for the development of a computer program for playing an alternate embodiment of the game.
Figure 6B:
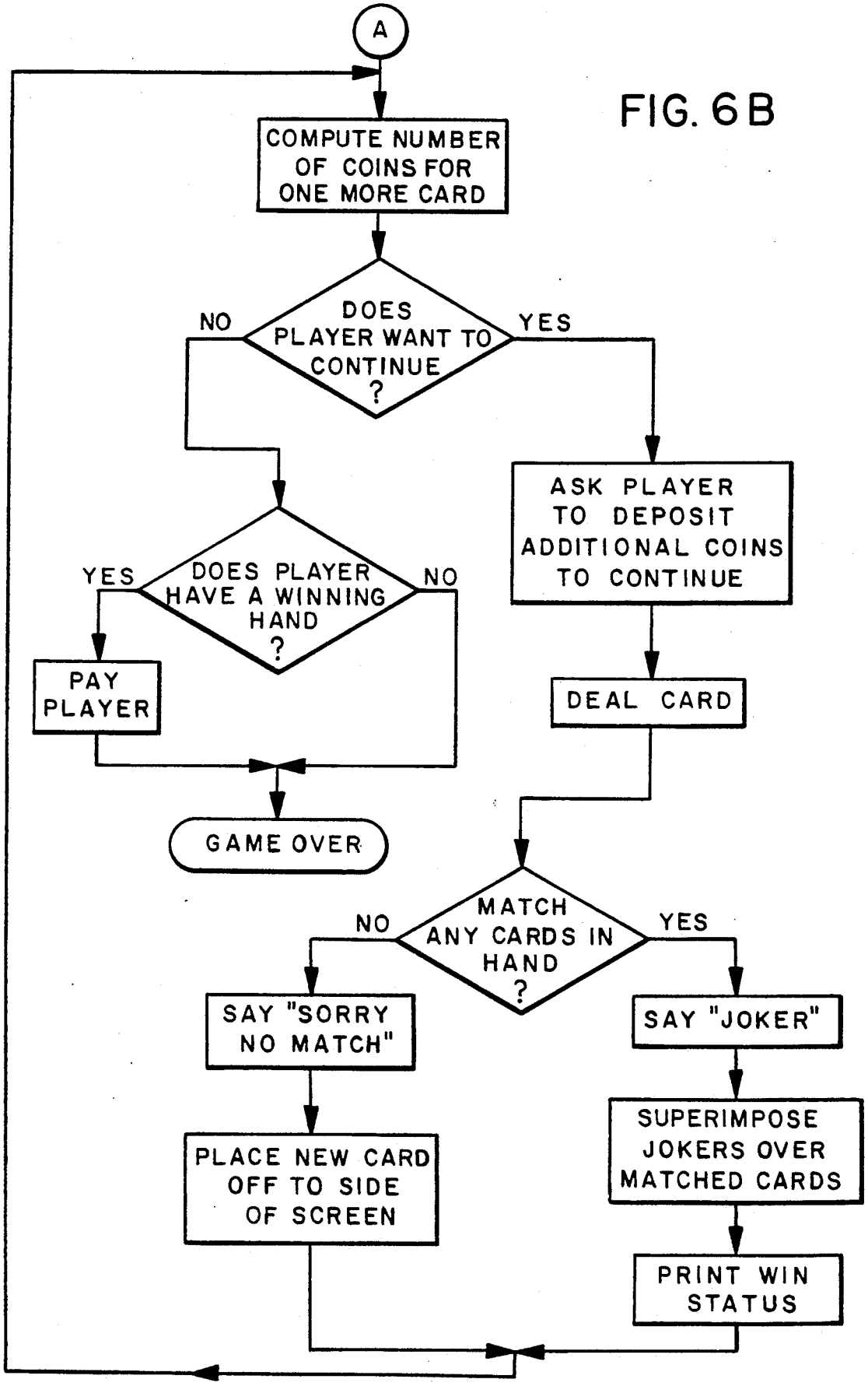
Figure 7:
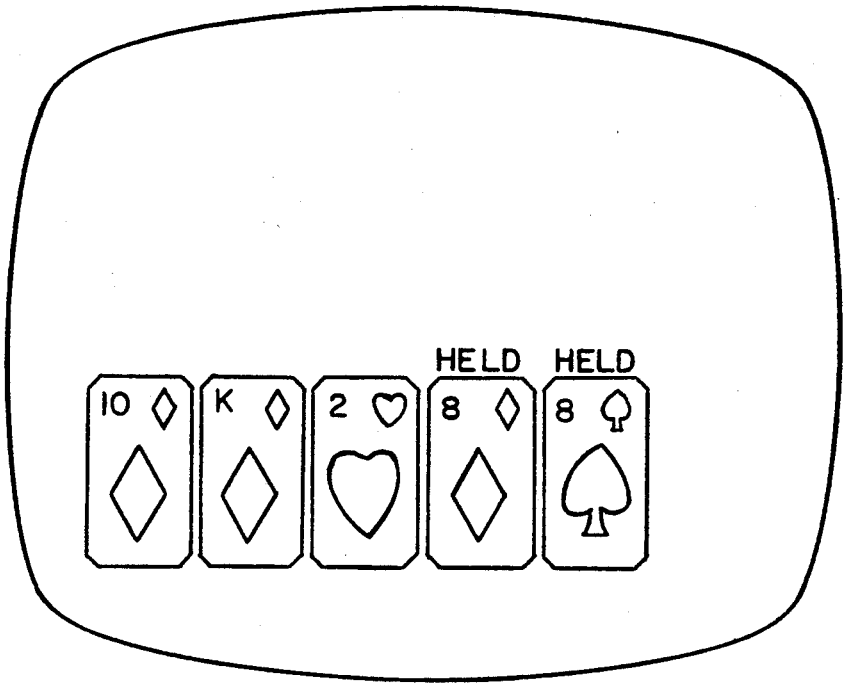
FIG. 7 shows two of the cards in the card hand being "HELD" as part of the alternate embodiment of the game.

In another embodiment of the invention, the game of this invention is played by having the wager first placed against a first hand dealt out of a card deck. FIG. 6 shows a flow chart for the development of a computer program for this embodiment. Table 2 is pseudo computer code for its implementation. As with the embodiments described above, any fixed number of cards can be dealt and two or more fifty-two card decks may be combined into the "deck" used for the game. As an example here, a five card hand is dealt and displayed on the video screen as shown in FIG. 7.

Figure 8:
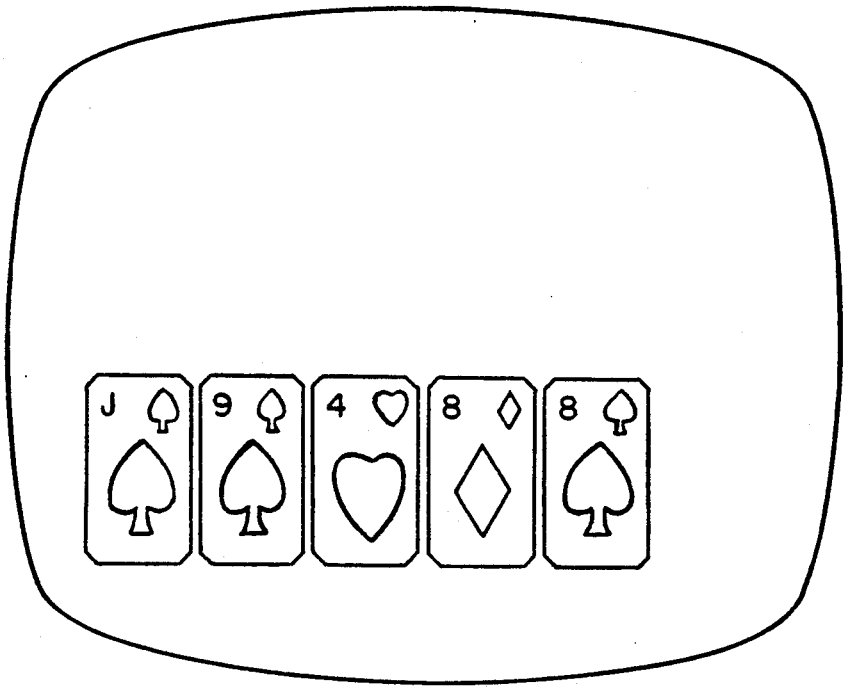
FIG. 8 shows three new replacement cards having been dealt for the non-"HELD" cards in FIG. 7.

The player may now discard and replace some or all of the cards on the screen. Alternatively, the player may hold one or more of the cards and indicate his decision by inputting his choice for each card into the computer, with an indication appearing on the video screen for each card that he wishes .to hold. This is illustrated by the HELD marker appearing on the video screen shown in FIG. 7. The player thereafter may change the status of each card as it appears on the video screen. The player is allowed to repeat such procedure until he is satisfied with the hold status of all cards in the first card hand. Confirmation is complete when the player directs the computer to proceed further with the game. The computer then proceeds to replace those cards which have not been marked HELD with a corresponding number of cards to be (preferably randomly) generated from the remaining deck of cards. The new cards thus generated in conjunction with those retained form a second hand which will be displayed by the computer on the video screen, as shown in FIG. 8.

At this time, the player is offered an opportunity to draw an additional card which may qualify as a Joker, similar to the step illustrated in FIG. 5. As shown in FIG. 5, the offer is coupled with the requirement that the player place a second wager, the amount of which is determined in a manner as described above.

If a player does not wish to place a second wager, he may terminate the game by directing the computer to do so by, for example, pushing the appropriate key on the key board or input terminal, by touching a touch sensitive area on the video screen, or directing a light pen's beam to a light sensitive area of the screen. In response to such action, the computer compares the ranking of the cards appearing on the screen to a payout table to determine whether the player has won or lost the game. The result of the game will be displayed on the video screen, together with any payout that is to be made in conjunction with a win.

The player accepts the challenge of the second wager by registering it with the computer. Responding to this action, the computer generates an additional card from the remaining deck of cards. This additional card will be displayed on the video screen as shown in FIG. 3. Thereafter the game proceeds as described above with respect to FIGS. 3, 4 and 5.

The foregoing description, figures and tables are presented for illustrative purposes only and are not intended to limit any and all alternatives, equivalents, modifications and rearrangements of elements falling within the scope of the invention as defined by the appended claims.

TABLE 1

| POKER GAME PSEUDO CODE |
|---|
| START: |
| input COIN_DEPOSIT |
| if COIN_DEPOSIT = NO |
| goto START |
| end if |
| DEAL_CARDS |
| input COIN_DEPOSIT |
| if COIN_DEPOSIT = NO |
| go to START |
| end if |
| DEAL_NEW_CARD |
| if MATCH_CARD_IN_HAND = YES |
| PRINT "JOKER" |
| SUPERIMPOSE_JOKERS_OVER_MATCHED_CARDS |

TABLE 1-continued

| POKER GAME PSEUDO CODE |
|---|
| PRINT_WIN_STATUS |
| goto BEGIN_POKER_GAME |
| end if |
| TELL_PLAYER_CARD_DOES_NOT_MATCH |
| PLACE_NEW_CARD_TO_SIDE_OF_SCREEN |
| goto BEGIN_POKER_GAME |
| end if |
| if HAND_IS_A_WINNER = YES |
| PAY_PLAYER |
| end if |
| END_OF_GAME: |

TABLE 2

| POKER GAME PSEUDO CODE |
|---|
| START: |
| input COIN_DEPOSIT |
| if COIN_DEPOSIT = NO |
| goto START |
| end if |
| DEAL_CARDS |
| LOOP: |
| input HOLD |
| if HOLD = YES |
| MARK_HELD_CARD |
| goto LOOP |
| end if |
| input CANCEL |
| if CANCEL = YES |
| DELETE_HOLDS |
| goto LOOP |
| end if |
| input DRAW |
| if DRAW = NO |
| goto LOOP |
| end if |
| REPLACE_NON-HELD_CARDS |
| BEGIN_POKER_GAME: |
| COMPUTE_NUMBER_OF_COINS_FOR_ADDITIONAL_CARD |
| input CONTINUE |
| if CONTINUE = YES |
| GET_COINS_TO_CONTINUE |
| DEAL_NEW_CARD |
| if MATCH_CARD_IN_HAND = YES |
| PRINT "JOKER" |
| SUPERIMPOSE_JOKERS_OVER_MATCHED_CARDS |
| PRINT_WIN_STATUS |
| goto BEGIN_POKER_GAME |
| end if |
| if HAND_IS_A_WINNER = YES |
| PAY_PLAYER |
| end if |
| END_OF_GAME: |

What is claimed is:

1. A method of playing a poker game in which a winning hand generates a payout to a player using a computer and a video screen which comprises:

registering a first wager with said computer;

generating and displaying on said video screen a first representation of a card hand consisting of plurality of cards from a deck of cards, each card in said deck of cards having a face value;

determining the poker rank of said hand based upon said face values of said first represented cards;

enabling said player to register a second wager with said computer;

if said second wager is registered, generating and displaying on said video screen a representation of an additional card from said deck of cards;

if said second wager has been registered, comparing the face value of said additional card with the face value of each of said first represented cards in said card hand and if said face value of said additional card matches the face value of a first card in said card hand, changing the value of all cards in said card hand having the same face value as said additional card to that of a joker to form a new poker rank for said hand;

determining whether and in what amount said payout is to be made to said player according to said new poker rank of said hand from a predetermined payout table; and terminating said poker game.

2. A method as in claim 1 which further comprises activating payout means for disbursing said payout.

3. A method as in claim 1 wherein the value of said payout is greater following the registration of said second wager than following the registration of said first wager.

4. A method as in claim 1 which further comprises, if said additional card does not match the rank of said first card in said hand, offering said player the opportunity to wager for another additional card from said deck of cards.

5. A method as in claim 1 which further comprises, if said additional card matches the rank of said first card in said hand, offering said player the opportunity to wager to another additional card from said deck of cards.

6. A method as in claim 1 wherein said deck of cards includes at least one Joker card.

7. A method as in claim 1 which further comprises offering to the player at least one opportunity to register additional wagers for additional cards prior to terminating said game.

8. A method as in claim 7 where the value of the payout following the registration of said additional wager is greater than that following the registration of preceding wagers.

9. A method as in claim 1 wherein said computer determines the value of said second wager, said payout or both prior to the registration of said second wager.

10. A method as in claim 9 which further comprises displaying a representation of said payout table on said video screen prior to registering each wager.

11. A method as in claim 9 wherein said payout table is not displayed on said video screen.

12. A method of playing a poker game in which a winning hand generates a payout to a player using a computer and a video screen which comprises the following steps:

registering a first wager with said computer;

randomly generating and displaying on said video screen a representation of a first card hand consisting of a plurality of cards from a deck of cards, each card in said deck of cards having a face value;

discarding any number of cards in said first card hand;

randomly generating and displaying on said video screen a representation of a replacement card for each card discarded to form a second card hand from said deck of cards;

offering to said player the choices of terminating said game or of placing a second wager for an additional card;

terminating said game if the player so chooses; or if the player chooses to place a second wager, randomly generating and displaying a representation on said video screen of an additional card from the cards remaining in said deck;

comparing the face value of said additional card with the face value of each of the cards in said second hand;

if the face value of said additional card matches the face value of a card in said second hand, changing the face value of all cards in said second hand having the same face value as said additional card to a value of a joker to form a poker rank for said second hand;

determining whether and in what amount said payout is to be made to said player according to said rank of said hand from a predetermined payout table, and terminating said poker game.

13. A method as in claim 12 further comprising, if the face value of said additional card does not match the face value of any of the cards in said second hand, offering said player the opportunity to wager for another additional card from the cards remaining in said deck of cards.

14. A method as in claim 12 further comprising, if the face value of said additional card matches the face value of any of the cards in said second hand, offering said player the opportunity to wager for another additional card from the cards remaining in said deck of cards.

15. A method as in claim 12 which further comprises activating payout means for the disbursement of said payout.

* * * * *